United States Patent [19]

Isler

[11] Patent Number: 4,627,453

[45] Date of Patent: Dec. 9, 1986

[54] ARTIFICIAL FINGERNAILS AND METHOD OF APPLICATION

[76] Inventor: Bonnie J. Isler, 1801 James Town Rd., Apt. 1, Belleville, Ill. 62221

[21] Appl. No.: 621,244

[22] Filed: Jun. 15, 1984

[51] Int. Cl.[4] ..... A45D 29/00

[52] U.S. Cl. ..... 132/73

[58] Field of Search ..... 132/73, 73.5

[56] References Cited

U.S. PATENT DOCUMENTS 3,478,756 11/1969 Sautter et al. ..... 132/73

4,007,749 2/1977 Matranga et al. ..... 132/73

4,157,095 6/1979 Sweet ..... 132/73

4,299,243 11/1981 Umstattd ..... 132/73

*Primary Examiner*—Robert P. Swiatek

*Assistant Examiner*—Cary E. Stone

*Attorney, Agent, or Firm*—Harvey B. Jacobson

[57] ABSTRACT

An artificial fingernail is formed from layers of organic fabric, such as flax, linen and silk, applied layer by layer over a wearer's natural nail with an adhesive, and hardened with a hardening solution. The first layer may be linen or flax and have its inner end spaced from the cuticle, while the second layer may be silk with its inner end adjacent the cuticle.

8 Claims, 7 Drawing Figures

ARTIFICIAL FINGERNAILS AND METHOD OF APPLICATION

BACKGROUND OF THE INVENTION

This invention relates to a method and means for the in situ forming of artificial fingernails using an organic nail wrapping technique to improve the appearance of, reinforce, and/or extend human fingernails.

STATEMENT OF PRIOR ART

Preformed artificial fingernails are known, for application over a natural nail by Nail Glue or the like. Such preformed nails, however, do not accurately fit the contours of all natural nails and their bonding power is not always sufficient to insure reliable adhesion.

Brush-on nails are also known consisting, for example, of Liquid Nail solution and a powder. In this system, a form is placed around the wearer's finger, and the powder and Liquid Nail is brushed on the nail and extended over the nail form to make a long artificial nail. A problem with this type of nail, however, is that it hardens to a porcelain-like consistency with little flexibility, making it susceptible to cracking and popping off. If the powder and solution is brushed on heavily to prevent cracking, the nail is artificial looking. When growing out these nails acquire a ridge requiring frequent touching up.

The weight of artificial nails of the above type may cause breakages of more fragile natural nails to which they are applied by creation of a leverage point causing bending of the natural nail, because of extra weight placed out on the ends of natural nails.

The following U.S. patents disclose examples of prior proposals relating to artificial nails. None of these, however, discloses the features of the present invention.

U.S. Pat. No. 1,978,144, Oct. 23, 1934;
U.S. Pat. No. 2,607,356, Aug. 19, 1952;
U.S. Pat. No. 2,864,384, Dec. 16, 1958;
U.S. Pat. No. 3,925,426, Feb. 4, 1969;
U.S. Pat. No. 3,993,084, Nov. 23, 1976;
U.S. Pat. No. 4,299,243, Nov. 10, 1981.

SUMMARY OF THE INVENTION

In accordance with the present invention, an artificial nail is formed from organic fabric applied over a wearer's natural nail with Nail Glue, trimmed to shape, and rapidly hardened by the application of Liquid Nail solution. Preferably, two staggered layers of organic fabric are applied over the natural nail, with the bottom layer being placed about 1/16 inch to 1/14 inch away from the cuticle, and consisting, for example, of linen, flax, or like fabric of the weight used, for example, in men's handkerchiefs (e.g. about 43 threads per inch or 68 threads per square inch). The top layer may comprise a thin fabric, such as silk, placed at the base of the cuticle, but not touching the cuticle. This layer smooths out the porous bottom layer and leaves only a slight line of demarcation which can be readily concealed by a wearer as the nail grows out. It is within the scope of the invention to omit the top layer, but its inclusion assists in smoothing out of the ridge at the base of the nail as well as the nail surface, and adds extra strength if nails are extended.

When a single layer, or a pair of layers of organic fabric are applied over a human nail with Cyanocrylate Nail Glue (Trademark) in accordance with the invention, the glue is partially absorbed by the fabric, and a lengthy period (up to an hour) may be required for the glue to dry sufficiently to allow the nail to harden to a state in which it can be filed of buffed. This problem is increased if additional glue is needed, for example, to smooth out uneven surfaces. Thus, in accordance with an important feature of the invention, Liquid Nail (Trademark) solution is applied to the glued fabric layer or layers to serve as a hardener for the Nail Glue. The Liquid Nail solution which contains Acrylic Ester Monomers, Di-Toludine, BHT, has a reaction with the Nail Glue, rapidly hardening same to enable filing and buffing of the artificial nail in a very short time down to one minute. Additionally, to build up and strength of fabric nails in accordance with the invention, particularly nails extended beyond the natural nail, Nail Glue Filler containing polyacrylic polymer may be applied.

The Cyanocrylate Nail Glue, Liquid Nail solution, and Nail Glue Filler are each of a known type generally available in beauty supply stores.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

The ensuing description refers to the application of an artificial nail to a single finger. It will be appreciated, however, in general, such nails will be applied to all of a wearer's fingers, so that breaks may occur between the various process steps as these steps are performed sequentially from finger to finger.

Figure 1:
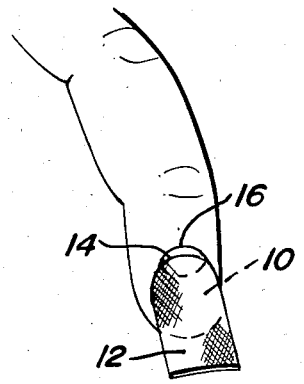
FIGS. 1 to 7 are semi-diagrammatic representations respectively of sequential steps employed in a process of applying an artificial fingernail over a wearer's natural nail in accordance with the invention.

Initially, the wearer's natural nail 10 should be soaked, completely cleansed, and the cuticle pushed and removed. The nail should be lightly buffed with an emery board or the like, without removal of the nail dust. Then, Nail Glue is applied to the surface of nail 10, and a first piece of organic fabric 12, such as linen or flax as previously referred to, precut to fit the natural nail but of greater length than the natural nail is applied to the nail bed with its inner end 14 spaced about 1/16 inch to 1/14 inch from cuticle 16 (FIG. 1). Fabric 12 may be firmly pressed into place using a 2-inch by 4-inch sheet of clear plastic film (not shown), for example.

Figure 2:
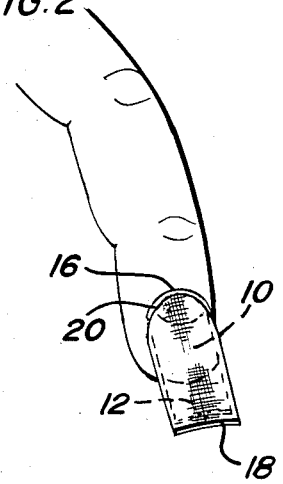
Figure 3:
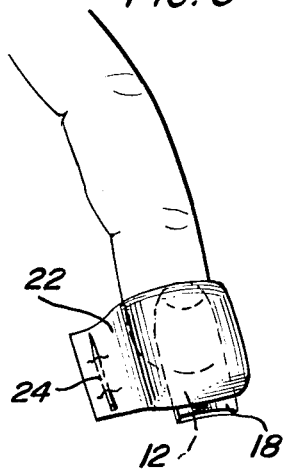

After removing the plastic film, a second precut layer 18 of organic material, such as silk as previously referred to, may be applied over layer 12 and in the same manner, but with the inner end 20 of layer 18 placed at the base of the cuticle 16 (FIG. 2) with a slight space between the cuticle and the material. If, in either layer, any of the fabric does not turn transparent upon application over the Nail Glue, the plastic may be removed, and additional Nail Glue applied to the required area of the fabric. The plastic may then be reapplied, and the nail wrapped with 1-inch by 4-inch elastic 22 (FIG. 3) tightly secured with a pin 24. The elastic may be removed after about 2 to 3 minutes.

Figure 4:
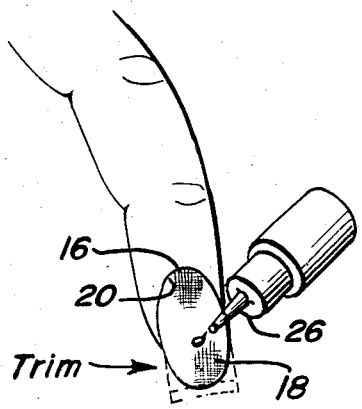
Figure 5:
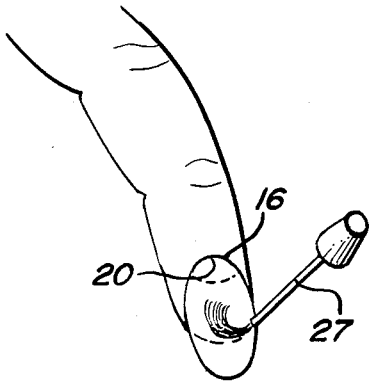

After removal of the elastic and plastic sheet, layers 12 and 18 may be trimmed to the approximate required length and shape (FIG. 4) and Nail Glue reapplied over the outer surface of nail 18 with a bottle nozzle 26. The Nail Glue should be allowed to dry for about 5 minutes, and then Liquid Nail solution as previously referred to is applied to the nail surface by a brush 27 (FIG. 5). Preferably two coats of Liquid Nail are applied consecutively. The Liquid Nail solution is a hardener and there is an epoxy reaction, possibly accompanied by a thermo-sensation, if it is applied too rapidly. If this should occur, further application of the Liquid Nail should be delayed for a few minutes.

Figure 6:
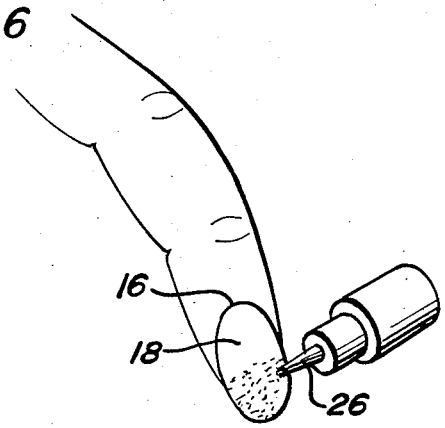

When the Liquid Nail solution has dried (generally about 5 minutes), a further coat of Nail Glue may be applied over the surface (FIG. 6) and allowed to dry. If any part of the nail needs to be built up, filled in, or extended, Nail Glue Filler may be sprinkled over the Nail Glue. Small amounts of Powder are sprinkled and Nail Glue added to the required area until the nail is built up as necessary. If the nail is extended, e.g. the fabric layers extending about $\frac{1}{4}$ to $\frac{1}{3}$ inch beyond the natural nail, the hand should be turned over, and the back of the nail reinforced with a small amount of Nail Glue Filler and Nail Glue.

Figure 7:
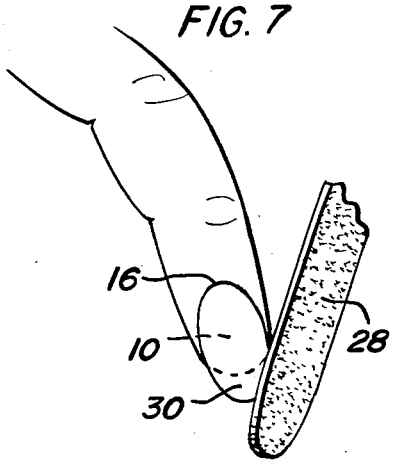

When dry, the thus completed artificial nail 30 may be shaped with an emery board 28 (FIG. 7) smoothing out the entire nail and making sure that the base of the artificial nail is even with the natural nail. The back of the nail should also be checked for smoothness. The nail may then be brushed with water, patted dry, and polished. Preferably three coats of polish are applied, with the base coat being a cream. If the first coat does not go on smoothly, it may be removed with tissue, and reapplied after smoothing out any roughness with an emery board.

The above-described process steps may be varied somewhat to suit particular conditions, and the time will depend on the sequence in which individual fingers are treated. In all cases, however, the Nail Glue and Liquid Nail should be given a 5-minute drying time when applied over an entire nail bed. An artificial organic nail in accordance with the invention may be extended, e.g. about $\frac{1}{3}$ inch beyond a wearer's natural nail, in which case the extended back and top of the nail should be reinforced with Nail Glue Filler and Nail Glue. Of the available organic fabrics, flax has a relatively high capacity to absorb Nail Glue and is optimal in adherence to a natural nail.

For maintenance and upkeep, about 6 to 8 weeks after application of the artificial nail, the wearer may soak, cleanse, push and remove the cuticle, and lightly buff the natural nail base with emery. Then, a layer of precut silk may be placed over the entire nail up to the cuticle using Nail Glue and a plastic sheet as previously described. After lifting the plastic, a further coat of Nail Glue is applied and, after 5 to 7 minutes, two light coats of Liquid Nail are applied by brush to harden the nail. The nail may, after hardening, be buffed and smoothed with emery and then polished.

Artificial nails in accordance with the invention may be soaked off at any time, using acetone polish remover and the nails may be reapplied as previously.

Once the nails have reached a desired length, usually in 6 to 12 weeks, this method may be used with 2 staggered layers of very thin organic material such as silk, first layer $\frac{3}{8}$ inch from cuticle, second layer $\frac{1}{4}$ inch from cuticle. After nails are polished, 5 to 8 coats of fast drying acrylic nail glaze must be applied over entire nail to maintain a strong high gloss nail. There is upkeep to this nail polish should be changed every two weeks or so. Nails will need to be rewrapped every 8 to 10 weeks depending on rate of nail growth.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method of forming an artificial nail including the steps of adhering a first layer of organic material over substantially the entire surface of a wearer's natural nail with an inner edge of the first layer spaced from the wearer's cuticle, adhering a second layer of organic material over substantially the entire surface of the first layer with an inner edge of the second layer adjacent the cuticle, applying adhesive over the second layer and then applying hardening solution to harden the nail.

2. The invention of claim 1 wherein the first layer comprises a flax or linen fabric and the second layer comprises a silk fabric.

3. The invention of claim 1 including the steps of pressing each of said layers against the natural nail with a plastic sheet or the like.

4. The invention of claim 1 including the step of applying an additional coat of adhesive over the hardening solution after the hardening solution has dried.

5. The invention of claim 4 wherein after allowing the additional coat of adhesive to dry, the nail is buffed and polished.

6. The invention of claim 1 including the step of building up, filling in, or extending a part of the nail by sprinkling powder over said part of the nail and mixing same with adhesive over the hardening solution after the solution has dried.

7. The invention of claim 1 wherein said layers are extended beyond the wearer's natural nail and the method includes the step of reinforcing the back of the extended portion with a filler and adhesive.

8. A method of forming an artificial nail including the steps of adhering a first layer of organic material over substantially the entire surface of a wearer's natural nail with an inner edge of the first layer spaced from the wearer's cuticle, adhering a second layer of organic material over substantially the entire surface of the first layer with an inner edge of the second layer adjacent the cuticle, applying adhesive over the second layer and then applying hardening solution to harden the nail, wherein the first layer comprises a flax or linen fabric, and the second layer comprises a silk fabric, and including the steps of pressing the layers against the natural nail with a plastic sheet or the like, wrapping the nail with a sheet of elastic wound around the plastic sheet over the second layer, retaining the nail in wrapped condition for a period of minutes and unwrapping the nail prior to the application of the adhesive and hardening solution to the second layer.

* * * * *